United States Patent [19]

Yokoyama et al.

[11] Patent Number: 4,855,701

[45] Date of Patent: Aug. 8, 1989

[54] POLARIZED ELECTROMAGNET

[75] Inventors: Yoichi Yokoyama, Amagasaki; Hiroaki Hamaguchi, Toyonaka; Kideya Kondo, Hirakata; Youichi Kunimoto, Osaka; Manabu Yano, Shijyonawate, all of Japan

[73] Assignee: Electric Power Research Institute, Inc., Palo Alto, Calif.

[21] Appl. No.: 267,219

[22] Filed: Nov. 3, 1988

[30] Foreign Application Priority Data

Dec. 23, 1987 [JP] Japan ..... 62-326321
Jun. 9, 1988 [JP] Japan ..... 63-142556

[51] Int. Cl.[4] ..... H01F 7/08
[52] U.S. Cl. ..... 335/230; 335/234
[58] Field of Search ..... 335/229, 230, 234

[56] References Cited

U.S. PATENT DOCUMENTS

| | | | |
|---|---|---|---|
| 4,509,026 | 4/1985 | Matsushita | 335/85 |
| 4,598,263 | 7/1986 | Heyne et al. | 335/14 |
| 4,604,596 | 8/1986 | Yokoyama et al. | 335/14 |
| 4,604,599 | 8/1986 | Koehler | 335/234 X |
| 4,635,016 | 1/1987 | Guery et al. | 335/234 X |
| 4,730,175 | 3/1988 | Ichikawa et al. | 335/230 |

FOREIGN PATENT DOCUMENTS

| | | | |
|---|---|---|---|
| 0148305 | 8/1984 | Japan | 335/230 |

*Primary Examiner*—George Harris

*Attorney, Agent, or Firm*—James P. Hillman

[57] ABSTRACT

A polarized electromagnet with improved response sensitivity includes an axially movable core 63 extending through an excitation coil 61 to be movable between two positions upon energization and deenergization of the coil 61. The core 63 is formed at its opposite ends respectively with pole plates 69 extending transversely of the core axis. Inner and outer yokes 64 and 65 are arranged in parallel to the core 63 and are magnetized to the opposite polarities by a permanent magnet 65. Inner and outer yokes 64 and 65 have at respective ends inner and outer pole ends 67 and 68 which are spaced axially to each other so as to form therebetween magnetic gaps in each of which the adjacent one of the pole plates 69 is located. At least one of the inner pole ends 67 terminates in a pole tip which is positioned transversely outwardly of the adjacent pole plate 69 and extends in the axial direction to a point where it overlies the adjacent pole plate 69 when the latter is magnetically attracted to the pole tip 67 such that the inward face of the pole tip 67 comes into direct facing relation to the lateral edge of the adjacent pole plate 69 when the pole plate 69 is attracted to the pole tip 67. Accordingly, it is possible to reduce the physical gap or the magnetic resistance between the pole tip 67 and the adjacent pole plate 69 in the position away from the pole tip 67 without reducing the stroke of the core in the axial direction.

7 Claims, 14 Drawing Sheets

POLARIZED ELECTROMAGNET

BACKGROUND OF THE INVENTION

1. Field of the Invention

The present invention is directed to a polarized electromagnet, and more particularly to an improvement on a polarized electromagnet with an axially movable core which extends through an excitation coil and which has pole plates at its opposite ends respectively located between magnetic gaps formed between the opposite poles of permanent magnet means for axial movement upon energization and deenergization of the excitation coil.

2. Description of the Prior Art

Such polarized electromagnet is well known in the art. For example, U.S. Pat. No. 4,509,026 discloses a general structure of the polarized electromagnet in which an axially movable core extends through an excitation coil with pole plates at the opposite ends of the core located in magnetic gaps formed between the opposed pole ends of inner and outer yoke means which are magnetized by permanent magnet means to opposite polarities. In this structure, the inner yoke means have its pole ends extending inwardly of the lateral ends of pole plates in abuttable relation therewith so that the pole plate comes into engagement with the adjacent pole end of the inner yoke means when attracted thereto. This means that each pole end of the inner yoke means is spaced axially from the adjacent pole plate being in the position magnetically repelled from the pole end by a distance exactly equal to the stroke required for the axial movement of the core. Thus, in order to move the pole plate towards the adjacent pole end of the inner yoke means by the energization of the coil it is always required to generate a magnetic force compensating for the magnetic resistance determined by that distance. In other words, the prior electromagnet has response sensitivity inherently and directly determined by that distance between the pole end of the inner yoke means and the adjacent pole plate in the position repelled away therefrom, and is therefore practically impossible to raise the response sensitivity without reducing that distance or the stroke of the core.

SUMMARY OF THE INVENTION

In view of the above problem, the present invention is contemplated to give improved response sensitivity to a polarized electromagnet without sacrificing its output stroke. The polarized electromagnet in accordance with the present invention comprises an excitation coil and an axially movable core extending through the excitation coil to be magnetically coupled therewith for movement between two positions upon energization and deenergization of the excitation coil. The core has at its opposite ends pole plates extending transversely of the core axis and is magnetically coupled through the pole plates to inner and outer yoke means which are magnetized to opposite polarities by permanent magnet means. The outer yoke means extends parallel to the core in transversely spaced relation thereto and has at its opposite ends respective outer pole ends which are located axially outwardly of the adjacent pole plates of the core. The inner yoke means extends parallel to the core inwardly of the outer yoke means and is formed at its opposite ends respectively with inner pole ends which are cooperative with the adjacent ones of the outer pole ends to form therebetween respective magnetic gaps in which the corresponding ones of the pole plates are positioned, respectively. The electromagnet of the present invention is characterized in that at least one of the inner pole ends terminates in a pole tip which is positioned transversely outwardly of the adjacent pole plate and extends in the axial direction to a point where it overlies the adjacent pole plate when the latter is in a position of being magnetically attracted to the pole tip such that the inward face of the pole tip comes into direct facing relation to the lateral edge of the adjacent pole plate in the attracted position. With this provision that the inner pole end or the pole tip is allowed to extend over or even past the adjacent pole plate being in the attracted position, it is possible to reduce the gap between the pole tip and the adjacent pole plate in the other position away from that pole tip, therefore reducing the magnetic resistance therebetween without accompanying the reduction in the stroke of the core. Accordingly, the electromagnet can require a correspondingly reduced magnetic force for switching the core to its attracted position to the pole tip of the inner yoke means from the other position, providing an improved response sensitivity of the core movement to the energizing signal.

It is therefore a primary object of the present invention to provide a polarized electromagnet which is capable of increasing the response sensitivity to the energizing signal without sacrificing the stroke of the core.

In a preferred embodiment, one of the inner pole ends defines the pole tip while the other pole end extends transversely into the path of the adjacent pole plate to define thereat a pole flange which comes into contact with the adjacent pole plate when the latter is magnetically attracted to said pole flange such that the core is held stable at the position where the pole flange attracts the adjacent pole plate by the magnetic force of the permanent magnet means and is driven to move towards the other position upon the energization of the electromagnet. The core is spring biased toward the stable position for assuring the core to return to the attracted position upon the deenergization of the electromagnet.

It is therefore another object of the present invention to provide a polarized electromagnet of monostable type which retains the improved response sensitivity.

Included in the electromagnet is a guide which is made of non-magnetic material and is fixed to the inner and outer yoke means. The guide extends between the pole tip and the adjacent pole plate and is formed with a guide surface along which the lateral edge of the pole plate is guided as the core moves axially between the two axially spaced positions. Thus, the core is smoothly guided in its axial movement without causing any lateral fluctuations, which is therefore a further object of the present invention.

In a modified version of the present invention, a polarized electromagnet of bistable type is shown in which each one of the inner pole ends defines the pole tip positioned laterally outwardly of the adjacent pole plate and extending in the axial direction to a point where it overlies the adjacent pole plate when the latter is magnetically attracted to the pole tip. The pole tips are spaced from the adjacent pole plates to form therebetween respective gaps with a magnetic resistance substantially equal to each other so that the core is rendered stable at either of the two axially spaced positions.

It is therefore a further object of the present invention to provide a polarized electromagnet of bistable type which retains the improved response sensitivity.

These and still other objects and advantages will become apparent from the following description of the preferred embodiment of the present invention when taken in conjunction with the attached drawings.

DETAILED DESCRIPTION OF THE PREFERRED EMBODIMENT

Figure 1:
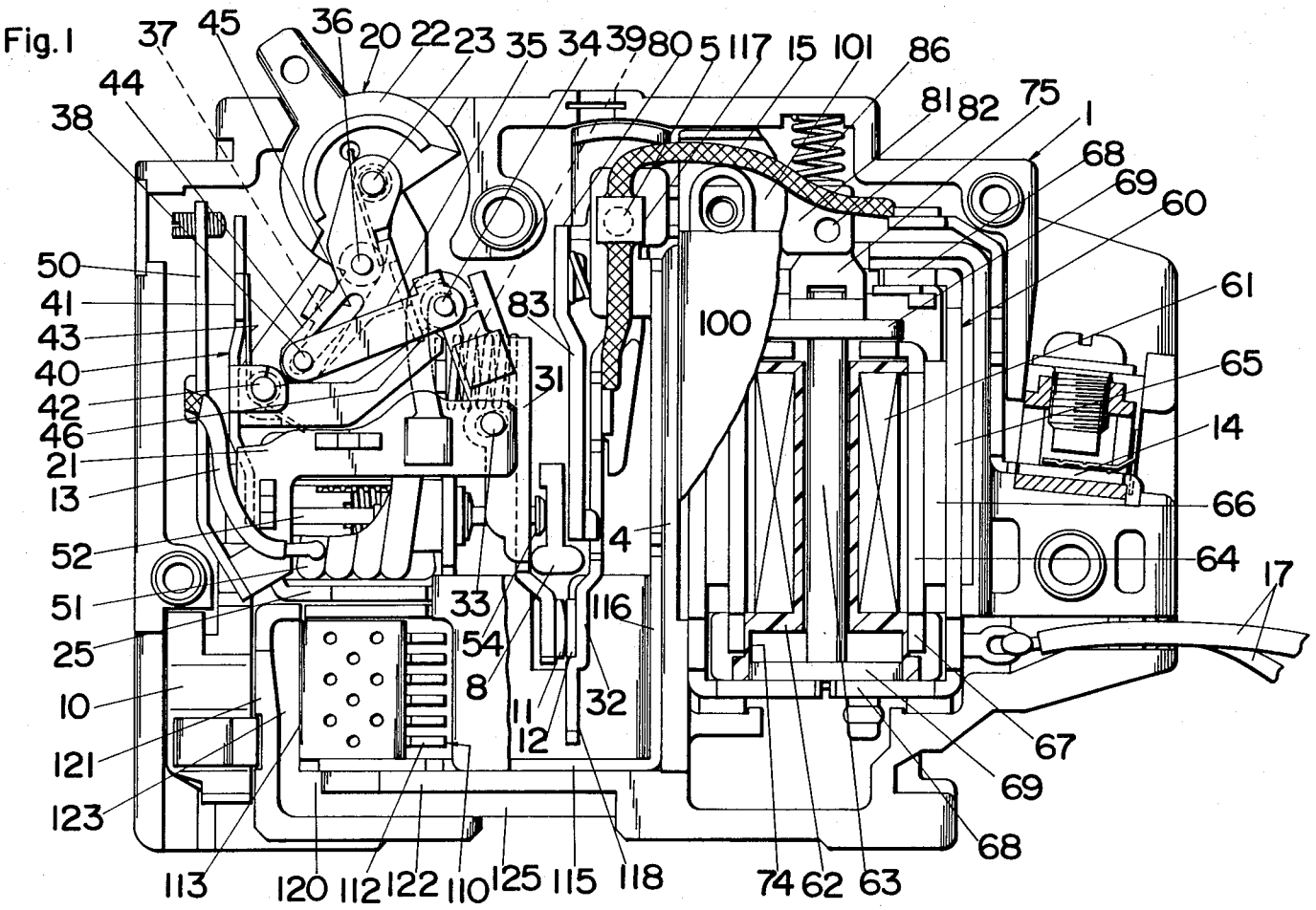
FIG. 1 is a vertical section of a remotely controllable circuit breaker employing an improved polarized electromagnet in accordance with a preferred embodiment of the present invention.
Figure 2:
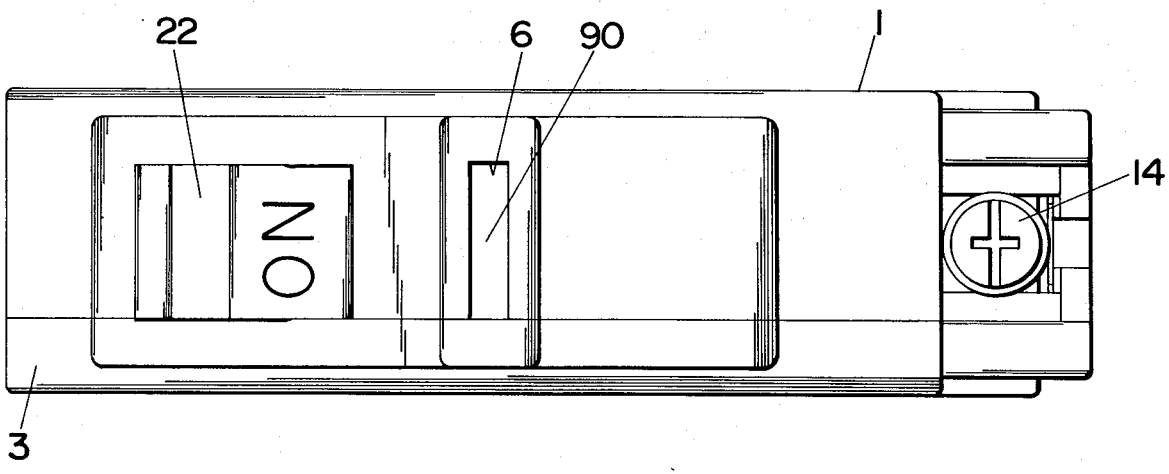
FIG. 2 is a top view of the breaker.
Figure 3:
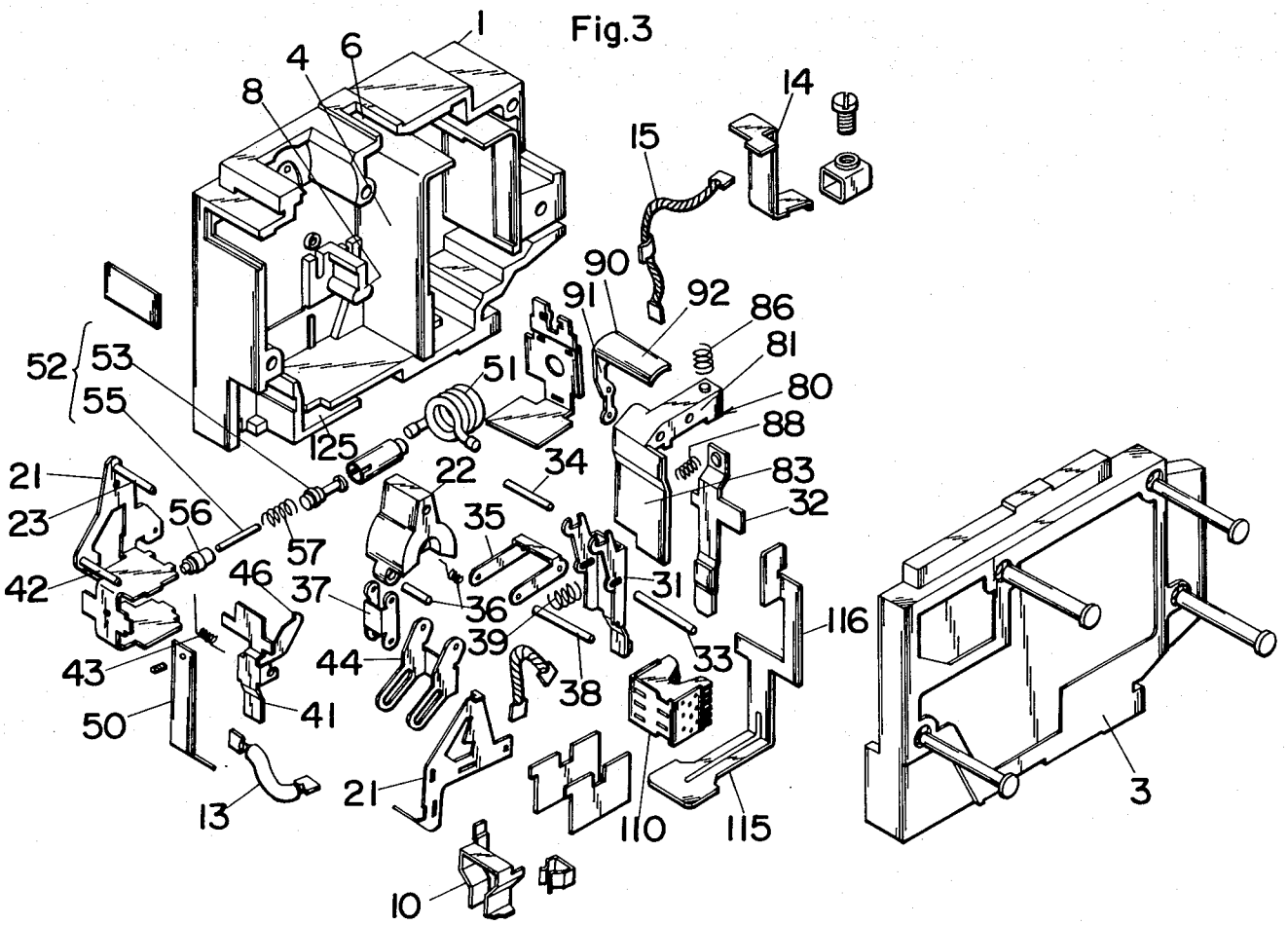
FIG. 3 is a exploded perspective view of the breaker.

Referring to FIGS. 1 to 3, there is shown a remotely controllable circuit breaker which incorporates a polarized electromagnet in accordance with a preferred embodiment of the invention. The breaker comprises a housing 1 of electrically insulative material in which a manually operable switching mechanism 20 is provided to open and close a single set of first and second breaker contacts 11 and 12 by manipulation of a manual handle 22.

The housing 1 includes a side cover 3 and is separated by a partition 4 into two compartments, one for receiving the switching mechanism 20 and the other for receiving a remotely controllable electromagnet switch 60 which is responsive to a remote control signal fed from a location remote from the breaker for opening the contacts, such remote control responsive contact opening operation overriding the manual switching operation to forcibly open the contacts 11 and 12.

The switching mechanism 20 comprises a frame 21 pivotally supporting the manual handle 22 about a handle pivot 23 at the upper end and a first movable contact arm 31 about a pivot pin 33 at the right end of the frame 21. The first movable contact arm 31 carries at its lower end the first contact 11 and is electrically connected to a line terminal 10 at the left end of the housing 1 by way of a braid 13, the frame 21, a bimetallic strip 50, and a magnetic coil 51. The second contact 12 is carried on the lower end of a second movable contact arm 32 extending vertically in generally parallel relation to the first contact arm 31 and electrically connected to a load terminal 14 at the right end of the housing 1 by way of a braid 15. The first contact arm 31 is pivoted at the middle of its length by the pivot pin 33 and is connected at its upper end to the handle 22 by way of pivot links 35 and 37 so that it is movable between an OFF position and an ON position as the handle 22 is manipulated to pivot about the handle pivot 23. The first contact arm 31 has its upper end connected to the pivot link 35 by a pivot pin 34. In FIG. 1, the first contact arm 31 is shown in its ON position where it has the first contact 11 in contact with the second contact 12 and is held in this position against the bias of a compression spring 39 by the action of a toggle linkage formed by pivot connections at pins 23, 36, and 38. The linkage connecting handle 22 and the first contact arm 31 in the present embodiment assures the contact closing in a delayed-make fashion and the contact opening in a quick-break fashion.

Included in the switching mechanism 20 is a trip mechanism 40 which opens the contacts 11 and 12 upon occurrence of predetermined overload current conditions detected by the bimetallic strip 50 or by the magnetic coil 51 which are connected in series between the first contact arm 31 and the line terminal 10. The trip mechanism 40 includes a latch lever 41 pivotally supported on the frame 21 and a cradle link 44 pivoted at its upper end to the handle 22 by the handle pivot 23. The cradle link 44 has a slit 45 for guiding therealong the pin 38 connecting the pivot links 35 and 37, and is therefore urged by the spring 39 in a clockwise direction in the figure about the handle pivot 23. The cradle link 44 is kept latched at 46 by the end of the horizontal arm of the latch lever 41 and is held in the position against the bias of the spring 39. The latch lever 41 is pivotable about a pin 42 and is urged by a torsion spring 43 in the counterclockwise direction as viewed in the figures. The vertical arm of the latch lever 41 extends along the bimetallic strip 50 in abuttable relation thereto.

Figure 11:
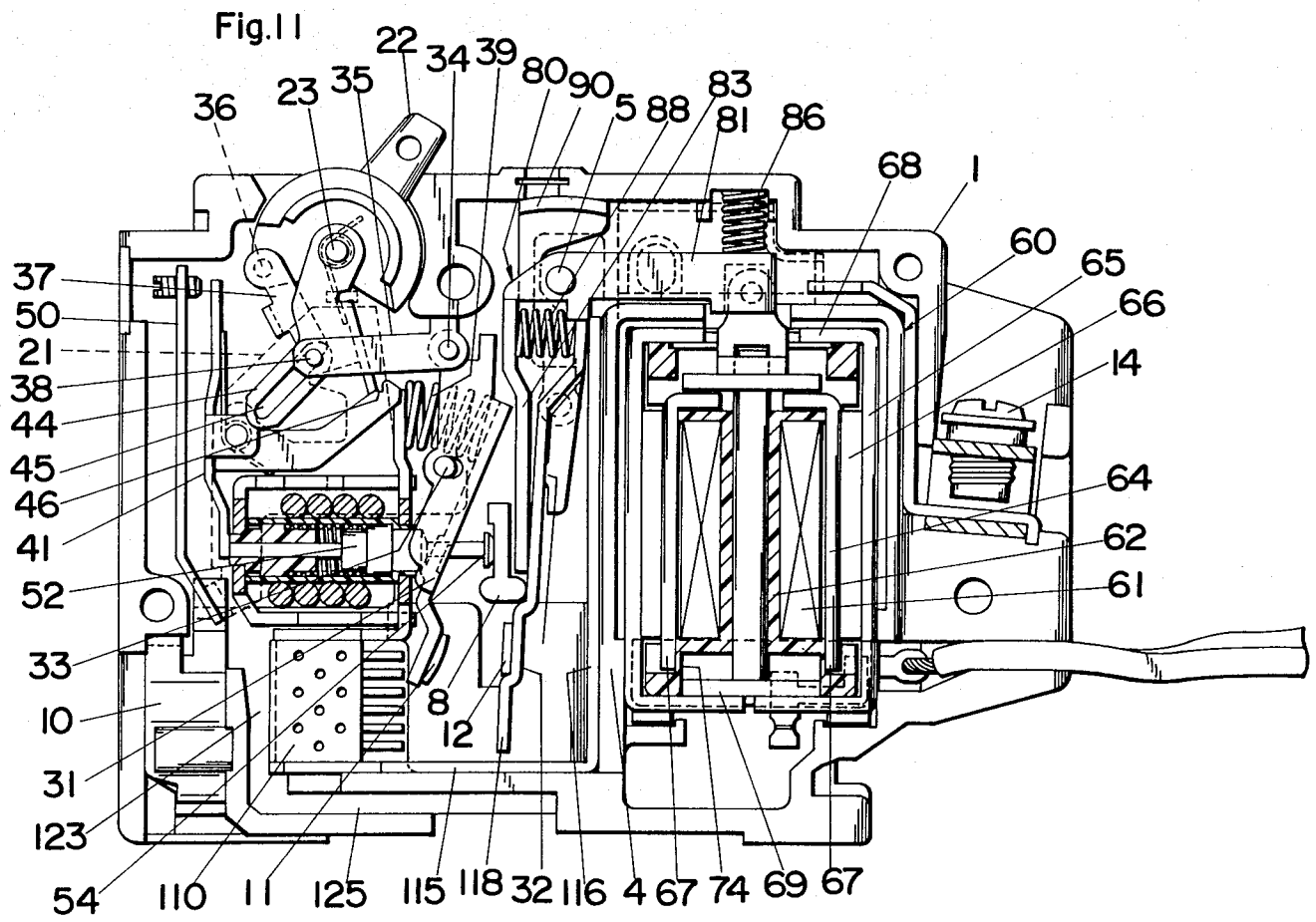
Figure 12:
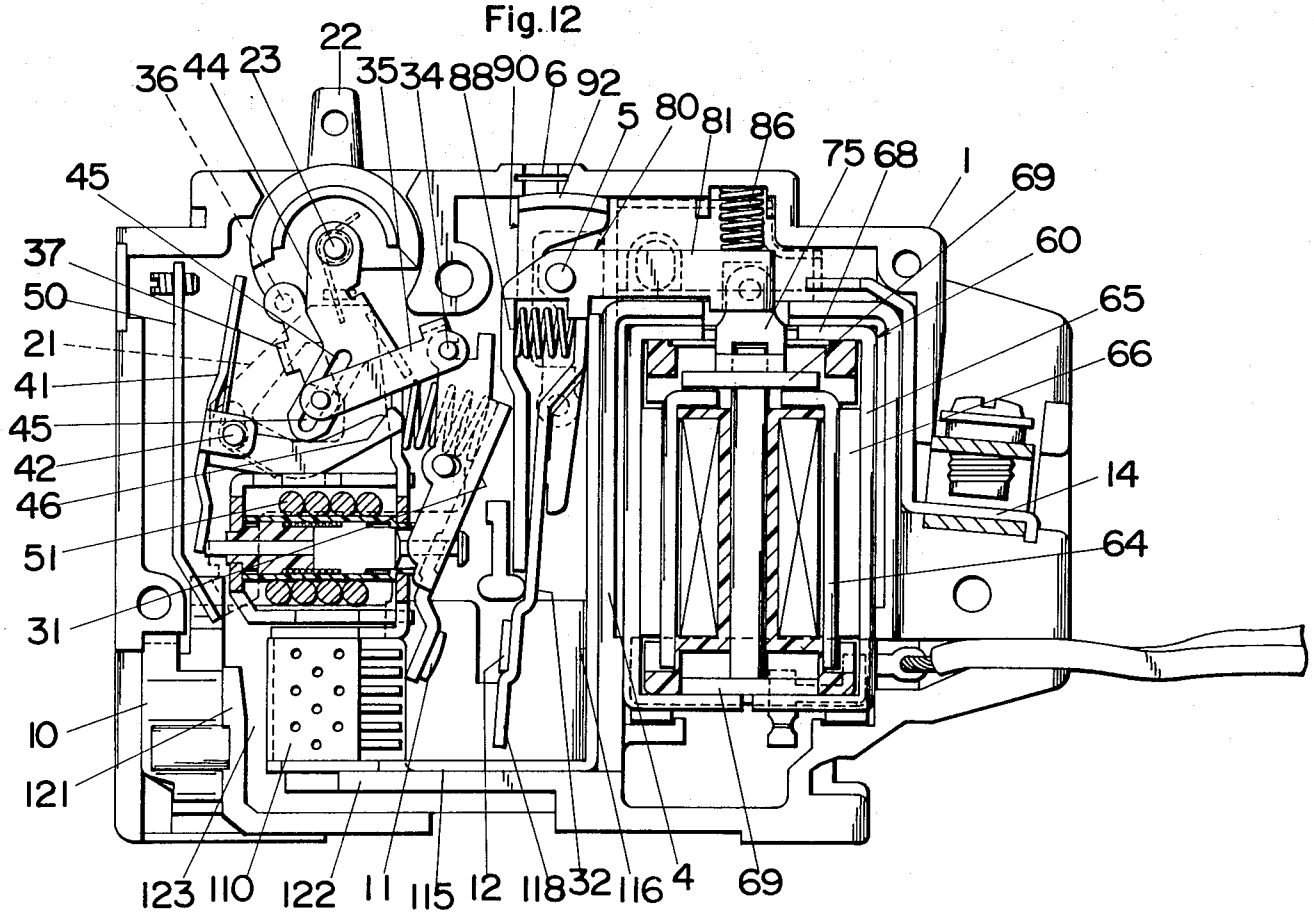
Figure 13:
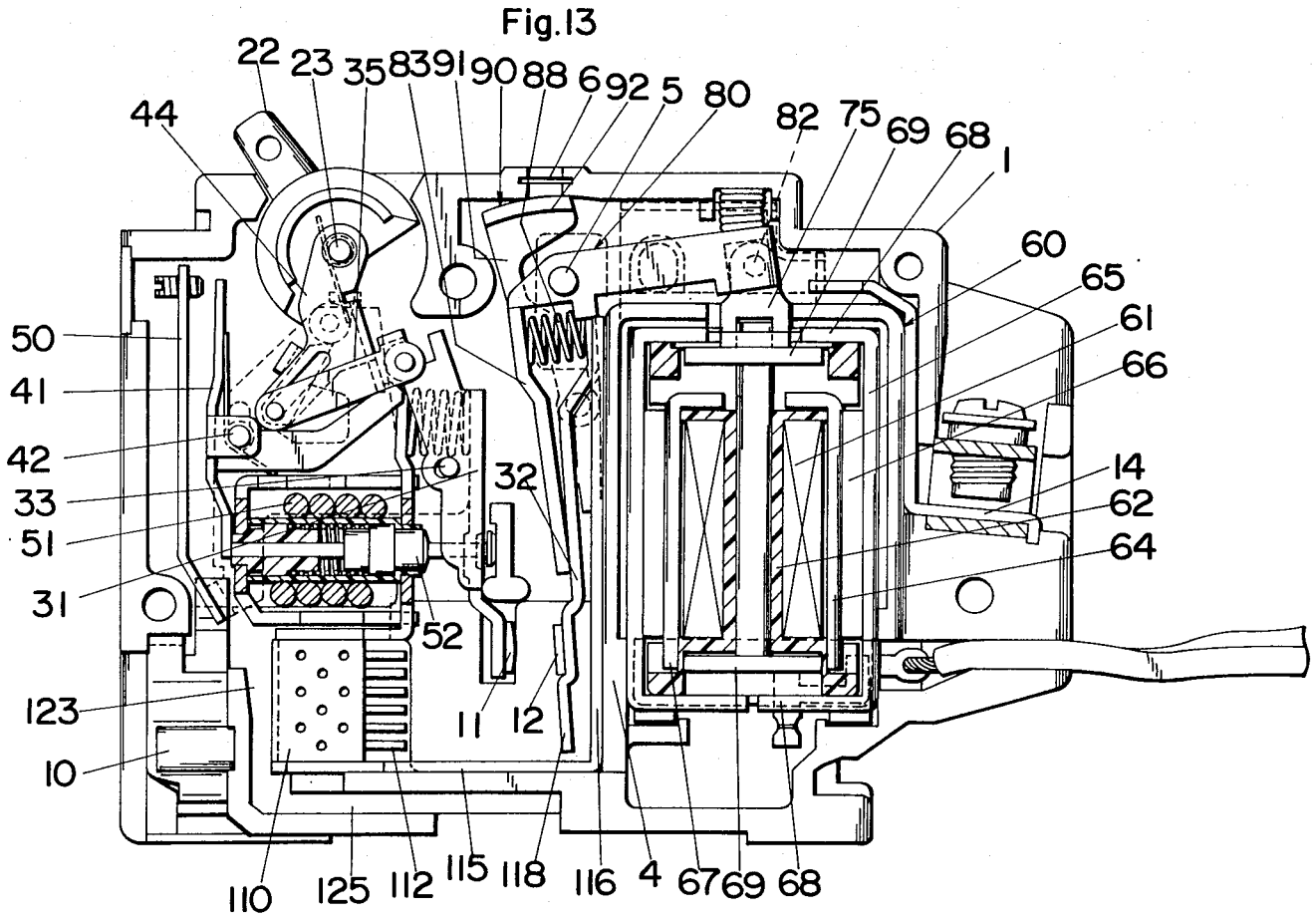

When the bimetallic strip 50 sees an overcurrent, it is deflected toward the vertical arm of the latch lever 41 to force the same to pivot in the clockwise direction, thus unlatching the cradle link 44. Upon this occurrence, the cradle link 44 is urged by the spring 39 to pivot in the counterclockwise direction to thereby pull the pin 38 retained in the slit 45 to the right, as seen in FIG. 11, thus forcing the first contact arm 31 to pivot about the pin 33 from the ON position to the OFF position.

The magnetic coil 51 includes a release rod 52 which extends therethrough to be axially movable. As shown in FIG. 3, the release rod 52 comprises a movable core 53 biased by a spring 57 away from a fixed core 56 at one end of the coil 51 and has at its one end a catch 54 for engagement with the first contact arm 31. The release rod 52 also includes a drive pin 55 extending through a fixed core 56 to be in abuttable against the lower end of the vertical arm of the latch lever 41. Upon the occurrence of an extreme overcurrent flowing through the circuit, the magnetic coil 51 is magnetized to thereby attract the movable core 53 towards the fixed core 56. At this time, the first contact arm 31 is pulled by the catch 54 of the movable core 53 to be forcibly disengaged from the second contact arm 32 for immediate contact separation. Also at the same time, the drive pin 55 is pushed by the movable core 53 to strike the lower end of latch lever 41, thus pivoting the latch lever 41 to unlatch the cradle link 44, after which the same tripping action is performed as initiated by the bimetallic strip 50 to keep the contacts opened until they are reset by the manipulation of the handle 22. In this manner, the contact separation effected by directly pulling the first contact arm 31 always precedes the contact separation by the trip action and therefore assures an immediate contact separation for protecting the load circuit from an extreme overcurrent condition. It is noted at this point that the first contact arm 31 is connected to the release rod 52 at a point opposite of the pivot axis 33 from the upper effort point 34 receiving the forces from the handle 22 as well as from the trip mechanism 40. With this structure, the release rod 52 can give an enough contact separation travel distance equivalent to that effected by the handle movement and the tripping action, yet allowing the magnetic coil 51 to be spaced from the effort point 35 along the length of the first contact arm 31 to such an extent as to accommodate within that length the parts or the portion of the switching mechanism 20. Thus, the switching mechanism 20 including the magnetic coil 51 can be made in a compact arrangement while retaining the immediate and reliable contact separation by the magnetic coil 51.

The second contact arm 32 is connected through an L-shaped actuator 80 to the remotely controllable electromagnet switch 60 to be driven thereby to move between an operative position where the second contact 12 is engageable with the first contact 11 and an inoperative or disable position where the second contact 12 is inhibited from engaging with the first contact 11 irrespective of the condition of the manually switching mechanism 20. The electromagnet switch 60 is activated in response to a remote control signal fed from a remote station through lines 17. In the present embodiment, the electromagnet switch 60 is a polarized electromagnet of monostable type which keeps the second contact 12 in the operative position of FIG. 1 in the deenergized condition and moves the second contact 12, upon being energized, to the inoperative position to disable a load connected to the breaker.

Figure 4:
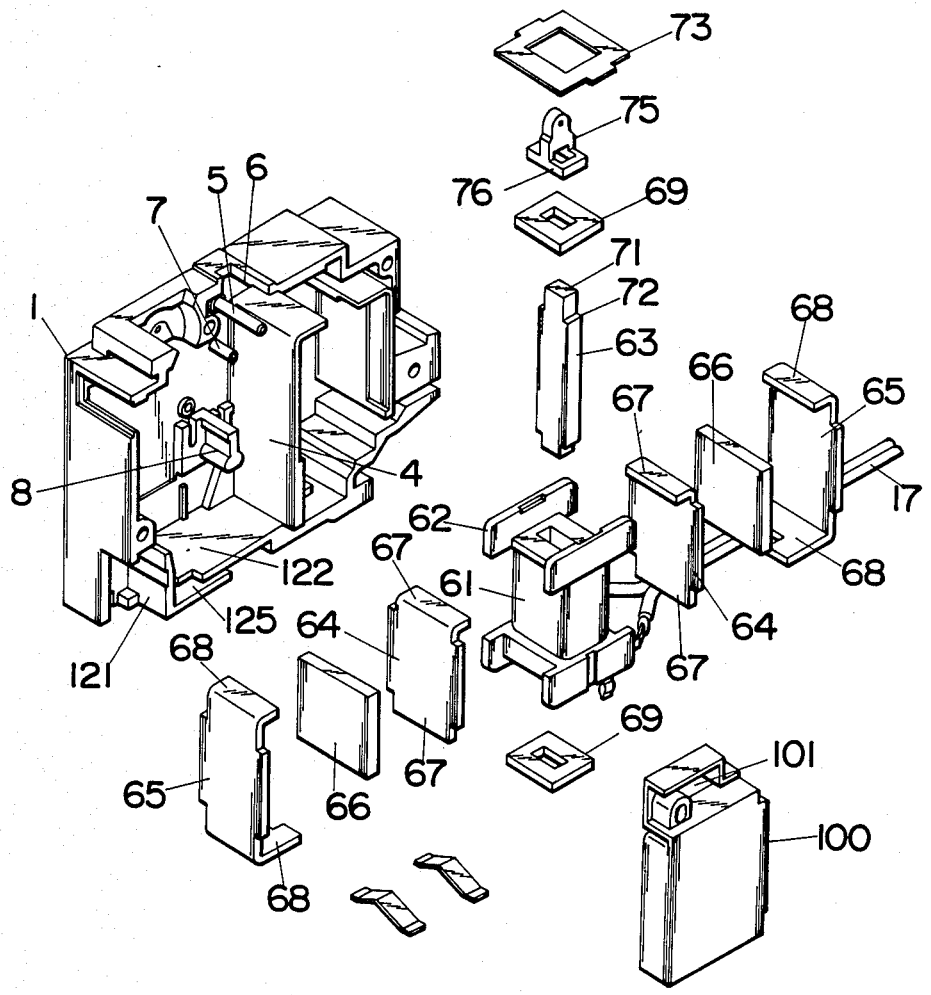
FIG. 4 is an exploded perspective view of the electromagnet.

The electromagnet switch 60 comprises, as best shown in FIGS. 1 and 4, an excitation coil 61 wound around a bobbin 62, an axially movable plunger core 63 extending through the bobbin 62, paired inner yokes 64, paired outer yokes 65, and permanent magnets 66 each interposed between the inner and outer yokes 64 and 65 to magnetize them in the opposite polarity. The inner and outer yokes 64 and 65 define inner and outer pole ends 67 and 68 respectively at the upper and lower ends thereof, and extend outwardly of the excitation coil 61 in parallel with the axis thereof so as to form magnetic gaps between the adjacent inner and outer pole ends 67 and 68. Provided respectively at the upper and lower ends of the plunger core 63 are pole plates 69 each located between the magnetic gap. The outer pole ends 68 at the upper and lower ends of the outer yoke 65 are bent at a right angle to form flanged pole ends to be abuttable with the corresponding one of the upper and lower pole plates 69. The inner pole end 67 is bent at a right angle only at the upper end of the inner yoke 64 to form a flanged pole end for abutment with the upper pole plate 69, while the inner pole end 67 at the lower end is spaced laterally outwardly from the pole plate 69 to form therebetween a constant air gap so that the plunger core 63 is stable at the position of FIG. 1 in which the upper and lower pole plates 69 are respectively in contact with the upper inner pole ends 67 and the lower outer pole ends 68 to complete the circuit of the magnetic flux emanating from the permanent magnets 66.

When the excitation coil 61 is energized by the control signal of a given polarity, the plunger core 63 is magnetized in the direction opposing the magnetic flux by the permanent magnets 66 to be thereby driven to move axially upwardly. The upper end of the plunger core 63 is connected to the L-shaped actuator 80 carrying the second contact arm 32 so that upon energization of the electromagnet 60 the upward movement of the plunger core 63 is transmitted to the second contact arm 32 to move the same into the inoperative position for opening the breaker circuit. In this position, the pole plate 69 at the upper end of the plunger core 63 abuts through a residual plate 73 against the flanged outer pole ends 68 at the upper ends of the outer yokes 65. Upon deenergization of the electromagnet 60, the plunger core 63 moves downwardly back to its stable position by the help of a return spring 86 acting on the connection between the plunger core 63 and the actuator 80, bringing the second contact arm 32 back into the operative position. The electromagnet switch 60 thus constructed is received within a cavity surrounded by the partition 4 with a joint 75 at the upper end of the plunger core 63 extending upwardly through the partition 4.

Figure 6:
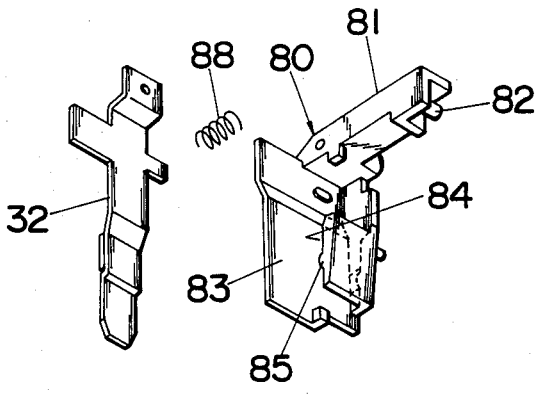
FIG. 6 is an exploded perspective view of an L-shaped actuator and a second contact arm employed in the breaker.

The L-shaped actuator 80 is made of electrically insulative material with a horizontal member 81 and a vertical member 83, and is mounted in the housing 1 outwardly of the partition 4 with its connection between the members 81 and 83 pivotally supported about a pivot post 5 integral with the housing 1. The horizontal member 81 extends over the width dimension of the electromagnet switch 60 and is connected at its free end by an integral pin 82 to the joint 75 at the upper end of the plunger core 63. The spring 86 biasing the plunger core 63 to its stable position is held between the end of the horizontal member 81 and the upper wall of the housing 1. The vertical member 83 likewise extends over the length dimension of the electromagnet switch 60 and carries the second contact arm 32 for movement thereof between the operative and inoperative positions. As shown in FIG. 6, the upper half portion of the second contact arm 32 is held within a slit 84 of the vertical member 83 with its lengthwise center abutting against a fulcrum projection 85 in the slit 84 and with a compression spring 88 interposed between the upper end of the second contact arm 32 and the vertical member 83. Thus, the second contact arm 32 is allowed to pivot about the fulcrum projection 85 to a limited extent relative to the vertical member 83 against the bias of the spring 88. This is contemplated to effect a rapid contact separation on the side of the second contact arm 32 in case of an extreme overcurrent flowing through the circuit. That is, the second contact arm 32 will be instantly driven to move away from the first contact arm 31 while the actuator 80 is kept stationary due to the electromagnetic repulsion forces acting between the first and second contact arms 31 and 32 extending in parallel relation to each other and seeing such extreme overcurrent, enabling prompt contact separation in advance of the contact separation by the tripping mechanism 40 for safely protecting the load. A stop 8 projects integrally from the housing 1 for abutment respectively with the first and second contact arms 31 and 32 upwardly of the first and second contacts 11 and 12.

Figure 7:
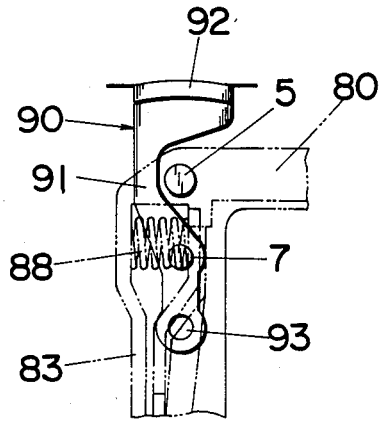
FIG. 7 is a partial view showing the mounting of an operation indicator in relation to the L-shaped actuator in the breaker.

An indicator 90 is mounted adjacent the actuator 80 to be pivotable together therewith between two angled positions indicative of the operative and inoperative positions of the second contact arm 32. The indicator 90 comprises a lever 91 extending in an overlying relation to the vertical member 83 of the actuator 80 and a display section 92 at the upper end of the lever 91. The display section 92 may be provided with markings for the inoperative and operative positions of the second contact arm 32 which can be viewed through a window 6 in the upper wall of the housing 1. As shown in FIG. 7, the lever 91 is pivoted at a pivot pin 7 spaced downwardly from the pivot axis 5 for the actuator 80 and is connected at its lower end 93 to the vertical member 83 of the actuator 80 in order to obtain a greater lever ratio for obtaining a sufficient amount of angular displacement of the display section 92 which is required for the changeover of the marking to be viewed through the window 6.

Figure 5:
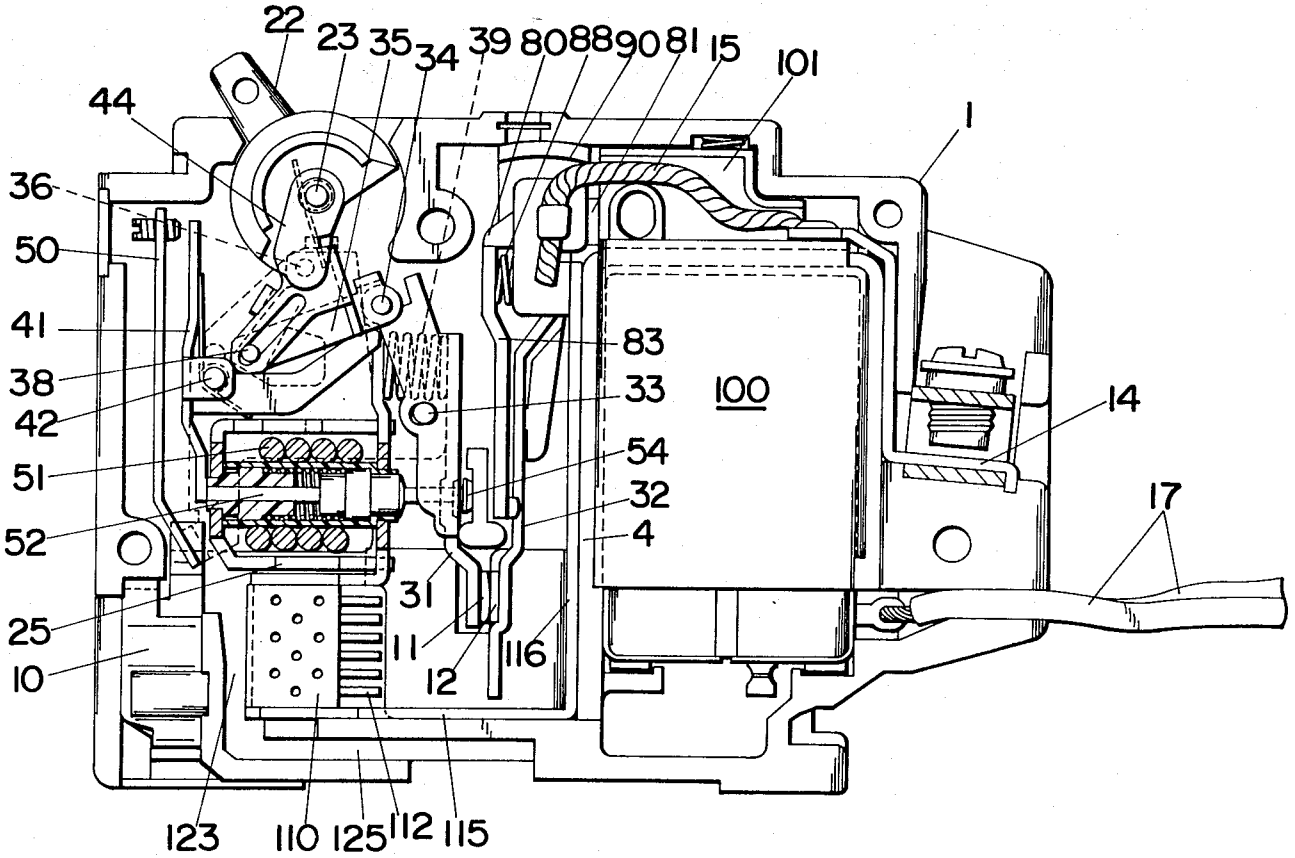
FIG. 5 is a vertical section of the breaker showing a protecting cover for the electromagnet.

As shown in FIGS. 4 and 5, a protective cover 100 of electrically and magnetically insulating material is provided to fit within the confines of the partition 4 over the electromagnet 60, completely insulating the electromagnet 60 from the adjacently disposed second contact arm 32 and the load terminal 14, and further from an arc drive member 116 extending along the outer vertical surface of the partition 4 in parallel with the second contact arm 32, the details of the arc drive member 116 will be discussed hereinafter with regard to an arc extinction mechanism. Integrally extending upwardly from the protective cover 100 is a grooved flange 101 which extends beyond the partition 4 to be fitted within the upper wall of the housing 1 and the upper end wall of the partition 4 in an overlying relation to the horizontal member 81 of the L-shaped actuator 80. It is within this grooved flange 101 that the braid 15 interconnecting the second contact arm 32 and the load terminal 14 is received so that it is also completely insulated from the electromagnet 60.

Figure 9:
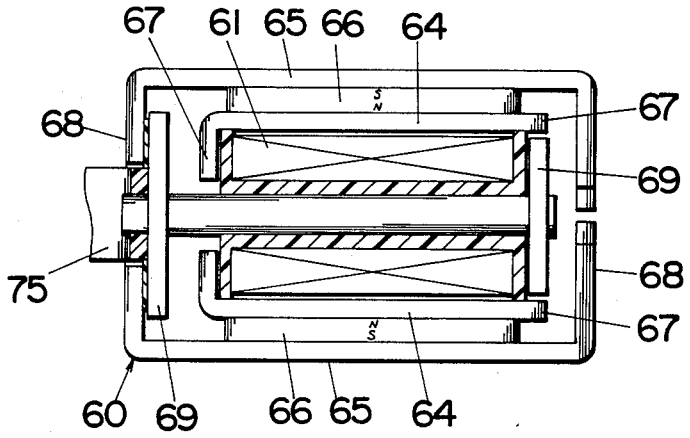
FIGS. 8 and 9 are explanatory views respectively showing the operation of the electromagnet.
Figure 8:
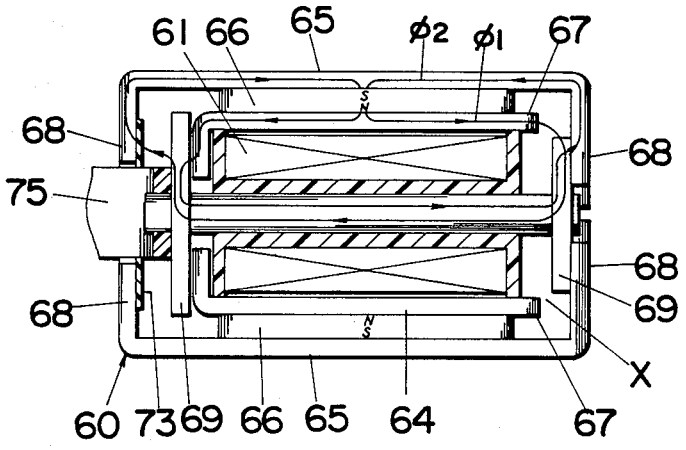
Figure 10:
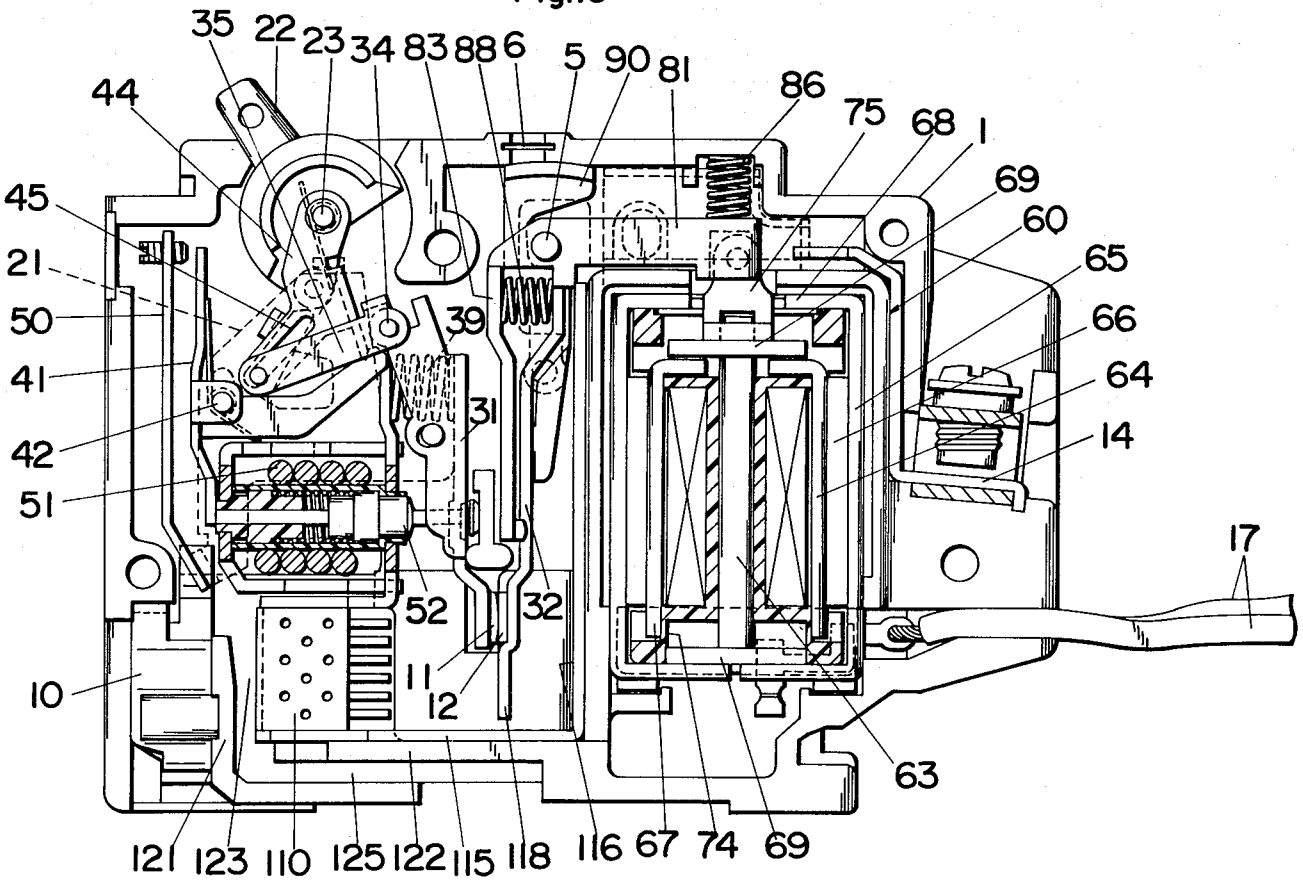
FIGS. 10 to 13 are respectively vertical sections illustrating various operating modes of the breaker.

Now referring to FIGS. 8 and 9, the electromagnet switch 60 will be discussed with its characterizing feature for improved response sensitivity to the control signal or reliable plunger movement upon the energization of the excitation coil 61. The electromagnet is characterized in that the inner pole end 67 at the lower end of each inner yoke 64 extends straight to define thereat a pole tip that is laterally spaced from the vertical plane in which the lateral edge of the adjacent pole plate 69 travels as the plunger core 63 moves axially in response to the energization and deenergization of the excitation coil 61. With this result, the pole tip 67 is permitted to extend over the lateral side of the adjacent pole plate 69 in its attracted position to the inner yokes 64 [FIG. 9] in order to reduce the gap or magnetic resistance between the pole tip 67 and the adjacent pole plate 69 in its attracted position to the outer yokes 65 [FIG. 10] while retaining a desired plunger stroke and without interference with the movement of the pole plate 69. Consequently, when the excitation coil 61 is energized to produce in the magnetic circuit a magnetic flux $\phi_1$ opposing the magnetic flux $\phi_2$ by the permanent magnet 66, the magnetic flux $\phi_1$ will pass through thus reduced gap X, or reduced magnetic resistance between the pole tip 67 and the adjacent pole plate 69, thereby increasing a magnetic attraction force acting on the plunger core 63 to move its axially upwardly to the position of FIG. 9 from the position of FIG. 10. In other words, the plunger core 63 can have an improved response sensitively to the energization of the excitation coil 61, or the remote control signal.

For achieving a smooth movement of the pole plate 69 in relation to the pole tips 67 of the inner yokes 64, the coil bobbin 62 is formed with a thin-walled guide segment 74 extending integrally from the lower flanged portion thereof into the clearance between the pole tip 67 and the lateral face of the adjacent pole plate 69. The guide segment 74 defines on its inner surface a smoothly finished guide surface along which the lateral edge of the adjacent pole plate 69 will be guided as the plunger core 62 is driven to move axially.

Figure 20:
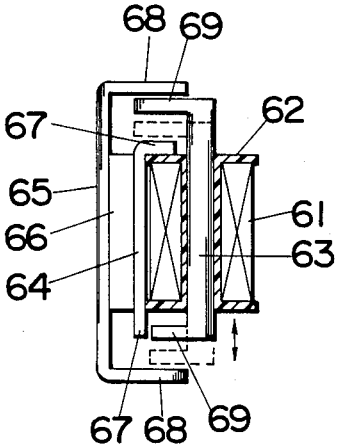
FIGS. 20 to 22 are respectively schematic views showing modified structures of the electromagnet.

Although the electromagnet 60 in the present invention is configured to be symmetrical with respect to the axis of the plunger core 63, it is equally possible to arrange an inner yoke 64, an outer yoke 65, a permanent magnet 66, and pole plates 69 on the one lateral side of the plunger core 63, as shown in FIG. 20.

Figure 21:
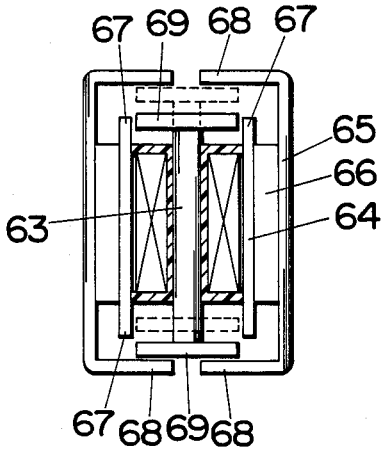
Figure 22:
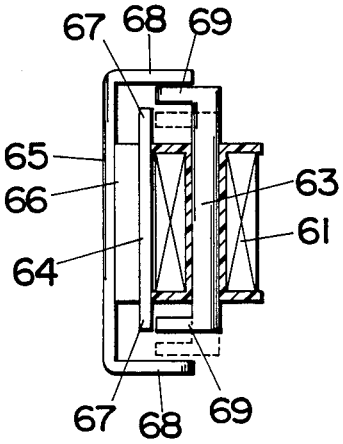

Further, the breaker of the present invention may utilize as a remote control switch means an electromagnet of bistable type, as shown in FIGS. 21 and 22, which holds the second contact at either of the inoperative and operative positions and switches the positions by receiving control signal of opposite polarities. In these modifications of FIGS. 21 and 22, the same scheme is applied to increase response sensitivity of the plunger core 63B, 63C to the energization of the excitation coil 61B, 61C by adopting the like arrangement that the inner yoke 64B, 64C has its pole ends, or pole tips 67B, 67C offset laterally outwardly of the adjacent pole plate 69B, 69C to permit the inner pole ends to extend over the lateral side of the pole plates 69B, 69C in their attracted position to the inner pole ends 67B, 67C.

Mounted in the bottom of the breaker housing 1 is an arc extinction assembly which comprises an arc chute 110, an arc runner 115 extending along the inner bottom of the housing 1 in the contact separating direction and terminating in the bottom of the arc chute 110, and the arc drive member 116 extending vertically along the partition 4 and connected at its lower end to the arc runner 115. The arc runner 115 is integrally formed with the arc drive member 116 and is electrically connected therethrough to the second contact arm 32 at 117. Once an arc is developed between the separating contacts 11 and 12 as seen in a rapid contact separation due to the overcurrent condition, one end of the arc is shifted from the second contact 12 onto the immediately adjacent portion of the arc runner 115 while the other end of the arc is on the first contact 11. As the first contact 11 travels along a path to its OFF position, the arc proceeds with the one end thereof anchored on the arc runner 115 into the arc chute 110 where it comes into contact with a stack of spaced arc shearing plates 112 to be extinguished thereat. The stack of the arc shearing plates 112 are supported by a holder 113 and disposed between the ends of the arc runner 115 and a horizontal plate 25 on the frame 21 of the switching mechanism 20.

When the arc is shifted to extend between the first contact 11 and the arc runner 115, the arc current will flow through a U-shaped path composed of the first contact arm 31, the arcing gap, the portion of the arc runner 115 and the arc drive member 116 extending generally in parallel relation to the first contact arm 31. Whereby electromagnetic repulsion forces are produced between the parallel conducting limbs of the U-shaped path and are concentrated on the arc to urge or drive it towards the arc chute 110 for rapid extinction of the arc. It is noted at this time that the arc drive member 116 constitutes the U-shaped arc current path instead of the second contact arm 32 upon the occurrence of the arc, keeping the second contact arm 32 free from the arc current and protecting the second contact 12 from being damaged by the arc. This is particularly advantageous in that the second contact arm 32 can be selected solely in view of its conductivity and without regard to arc resistivity, and that the arc drive member 116 and the arc runner 115 can be selected mainly in view of its arc resistivity. To this end, the second contact arm 32 is made from a copper or its alloy having a superior conductivity while the arc runner 115 and the arc drive member 116 are made of an iron or ferro alloy having good heat resistivity but relatively great electric resistance. With the use of such material having relatively great electric resistance for the arc runner 115 and arc drive member 116, a considerable current limiting effect can be obtained upon the arc current flowing therethrough, thereby contributing to the extinction of the arc.

Figure 15:
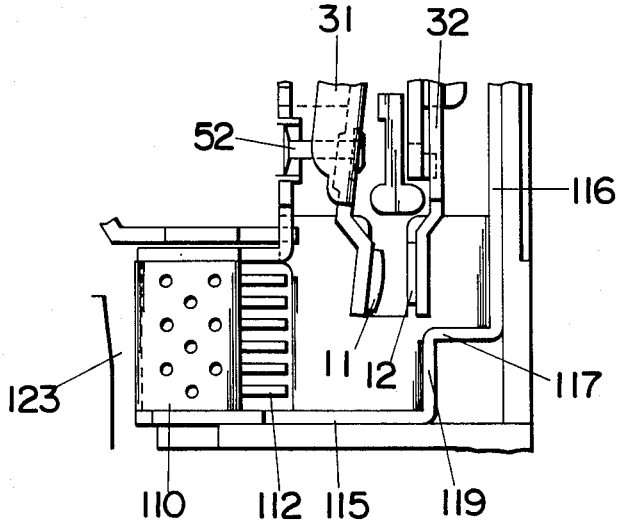
FIG. 15 is a partial front view illustrating an arc driving arrangement utilized in a modification of the breaker.

For enhancing to shift the one end of the arc to the arc runner 115, a pilot extension 118 extends from the lower end of the second contact arm 32 in close proximity to the arc runner 115. For the same purpose, the connection between the arc runner 115 and the arc drive member 116 may be bent toward the lower end of the second contact arm 32, as seen in FIG. 15, a modification of the present embodiment. In this modification, a vertical segment 119 is formed in the connection between the arc runner 115 and the arc drive member 116 to extend in a position closer to the first contact arm 31 than the substantial portion of the arc drive member 116. Thus, the vertical segment 119 acts to exert the electromagnetic force for urging the arc towards the arc chute 110, in addition to that it serves as a barrier for blowing back an arc gas towards the arc chute 110.

Figure 14:
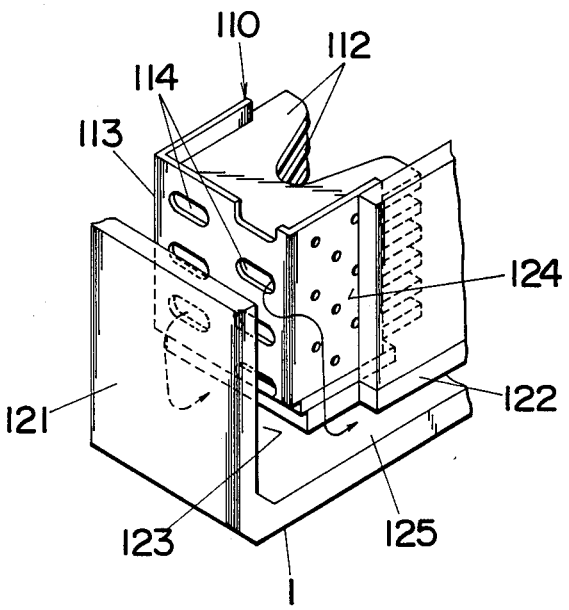
FIG. 14 is a partial perspective view of an arc extinguishing chute and its associated portion of the breaker housing.

For receiving the arc chute 110, there is formed in the lower portion of the housing 1 a chamber 120 which opens in the direction of the first and second contacts 11 and 12 and which is confined at its rear by a vertical rib 121, at its bottom by a horizontal rib 122, and at its opposite sides respectively by the housing 1 and the side cover 3. These ribs 121 and 122 are integral with the housing 1. The arc chute 110 is disposed in the chamber 120 with the rear wall of the holder 113 in spaced relation to the vertical rib 121 so as to form therebetween a space 123. As shown in FIG. 14, it is through this space 123 that escape ports 114 in the rear wall of the holder 113 communicate with an exhaust port 125 formed in the bottom wall of the housing 1 downwardly of the horizontal rib 122 for exhausting a volume of ionized gases produced by the arc reacting with its environments including the arc shearing plates 112. As seen in the figure, the side wall or the side cover 3 is notched to form on the rear portion of the side face of the arc chute 110 an additional space 124 which communicates rearwardly with the space 123 and downwardly with the exhaust port 125. Thus, the arc gas rushing out through the escape ports 114 can be routed through the spaces 124 and 125 along several flow courses as indicated by arrows in the figure toward the exhaust port 125 to be finally discharged outwardly of the housing 1. It is noted at this point that the vertical section of the partition 4 surrounding the electromagnet switch 60 acts as a barrier preventing the entry of the arc gas into the electromagnet 60 as well as to blow back the arc gas toward the arc chute 110 for expelling it through the escape ports 114.

Figure 16:
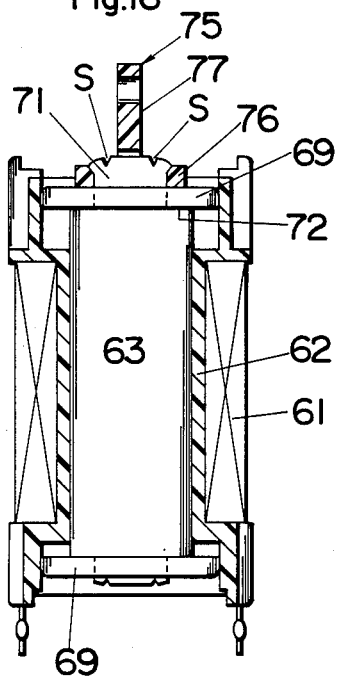
FIG. 16 is a front view illustrating the rigid connection between the plunger of the electromagnet and a joint for the second contact of the breaker.
Figure 17:
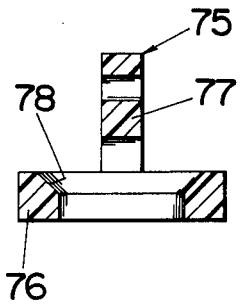
FIG. 17 is a sectional view of the joint utilized in FIG. 16.

FIG. 16 shows the connection of the plunger core 63 of the electromagnet 60 and the joint 75 utilized to couple the plunger core 63 to the horizontal member 81 of the L-shaped actuator 80. The joint 75 is made of a plastic material and comprises a square ring 76 and a tab 77 extending from the opposite sides of the ring 76, as shown in FIGS. 4 and 16, for pivotal connection by the pin 82 to the actuator 80. The ring 76 fits around a center stud 71 projecting from the upper end of the plunger core 63 with the upper pole plate 69 held between the ring 76 and a shouldered stop 72 on the upper end of the plunger core 63. After placing the ring 76 in position, the upper end of the stud 71 is struck at spaced points S by a suitable jig so as to partially deform the portion outwardly of the points S into engagement with a bevelled brim 78 formed around the inner periphery of the ring 76, thus rigidly connecting the joint 75 to the upper end of the plunger core 63 at the same time of connecting the pole plate 69 thereto.

Figure 18:
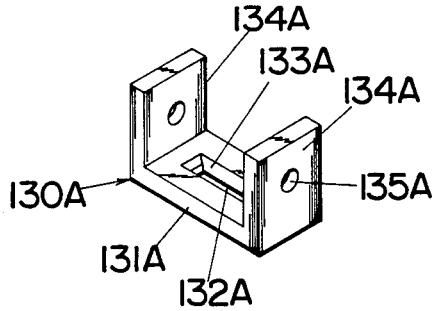
FIGS. 18 and 19 are respectively perspective views showing modifications of the joint utilized in FIG. 16.
Figure 19:
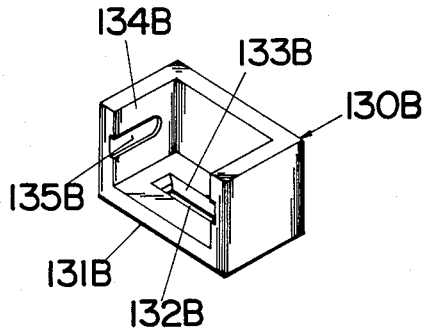

As shown in FIGS. 18 and 19, other types of joints 130A and 130B may be utilized instead of the joint 75. Each of the joint 130A and 130B comprises a base 131A, 131B with a pair of upward tabs 134A, 134B on the opposite sides thereof. The base 131A, 131B has in its center an aperture 132A, 132B with a beveled brim 133A, 133B around the upper edge thereof so that the upper end of the like plunger core extending through the aperture 132A, 132B can be partially deformed for engagement with the bevelled brim 133A, 133B in the like manner as described in the above. The tabs 134A and 134B are formed respectively with bearing holes 135A and bearing grooves 135B for pivotal connection to the horizontal member of the L-shaped actuator by means of a pin.

Figure 23:
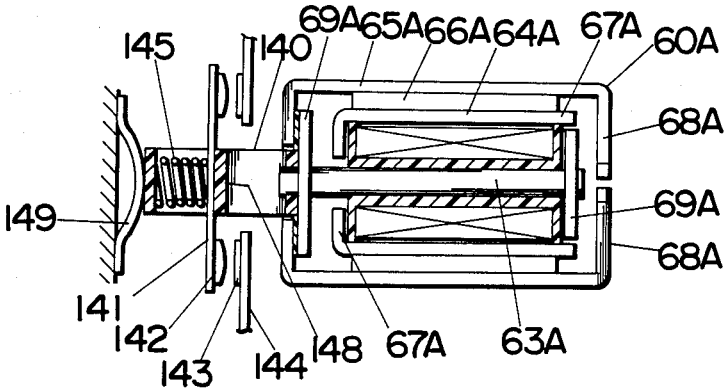
FIGS. 23 and 24 are respectively schematic views showing an electromagnetic contactor utilizing the electromagnet of the present invention.
Figure 24:
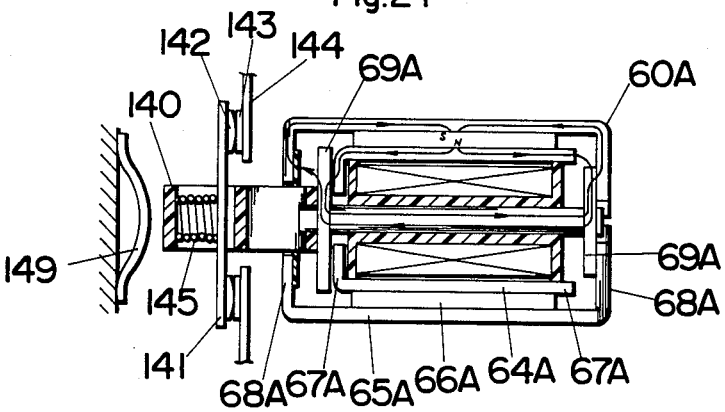

FIGS. 23 and 24 show an electromagnetic contactor as another application in which the electromagnet of the present invention is utilized. The parts of the electromagnet are designated by the like numerals with the suffix of A for an easy reference purpose. The contactor is of a normally closed switch and includes, in addition to the electromagnet 60A, an actuator 140 extending in the axial direction of the plunger core 63A and connected at its one end thereto. A contact arm 141 in the form of a spring leaf extends through the actuator 140 in perpendicular relation thereto and has first contacts 142 on its opposite ends for contact with second contacts 143 on individual fixed conductors 144. In the deenergized condition of the electromagnet 60A [FIG. 24], the contact arm 141 receives a retaining force from the end of the actuator 140 through a spring 145 to keep the contacts closed with a suitable contact pressure given by the spring 145. Upon energization of the electromagnet 60A, the actuator 140 is driven by the plunger core 63A to move the contact arm 141 at 148 in the direction of separating the contacts 142 and 143 [FIG. 23]. A return spring 149 is provided to act on the end of the actuator 140 in its contact separating position for assisting the plunger core 63A to move back to its stable position of FIG. 24.

What is claimed is:

1. A polarized electromagnet comprising:

an excitation coil;

an elongated core extending through said excitation coil to be magnetically coupled therewith for movement in its axial direction between two positions relative to said excitation coil upon energization and deenergization thereof, said core having at its opposite ends pole plates extending transversely of the axial length;

outer yoke means which is fixed relative to said excitation coil and extends parallel to said core in transversely spaced relation thereto, said outer yoke means having a its opposite ends respective outer pole ends which are located axially outwardly of the adjacent pole plates of said core;

inner yoke means which is fixed relative to said excitation coil and extends parallel to said core inwardly of said outer yoke means in transversely spaced relation to said core, said inner yoke means being connected to said outer yoke means by permanent magnet means so that said inner and outer yoke means are magnetized to the opposite polarities, said inner yoke means having at its opposite ends respective inner pole ends which are cooperative with the adjacent ones of said outer pole ends to form respective magnetic gaps between which the corresponding ones of said pole plates are located;

at least one of said inner pole ends terminating in a pole tip which is positioned transversely outwardly of the adjacent pole plate and extends in the axial direction to a point where it overlies the adjacent pole plate when the latter is magnetically attracted to said pole tip such that the inward face of said pole tip comes into direct facing relation to the lateral edge of the adjacent pole plate when said pole plate is attracted to said pole tip.

2. A polarized electromagnet as set forth in claim 1, wherein the one of said inner pole ends defines said pole tip and the other inner pole end extends transversely inwardly into the path of the adjacent pole plate to define thereat a pole flange which comes into substantial contact with the adjacent pole plate when the latter is magnetically attracted to said pole flange, and said core being spring biased toward one of said positions in which one of said pole plates comes into substantial contact with said pole flange so as to be kept stably retained thereon by a magnetic force of said permanent magnet when the said excitation coil is deenergized.

3. A polarized electromagnet as set forth in claim 1, wherein each one of said inner pole ends defines said pole tip, said pole tips being spaced from the adjacent pole plates to form therebetween respective gaps with a magnetic resistance substantially equal to each other.

4. A polarized electromagnet as set forth in claim 1, further including a guide of non-magnetic material which is fixed to said inner and outer yoke means and extends between said pole tip and the adjacent pole plate, said guide forming thereon a guide surface along which the lateral edge of said pole plate will be guided as said core moves axially between said two positions.

5. A polarized electromagnet as set forth in claim 1, wherein said pole plates are formed on the opposite axial ends of said core so as to be symmetrical with respect to the axis of said core, and said outer and inner yoke means and said permanent magnetic means are disposed together on the opposite sides of said core in symmetrical relation to each other with respect to the axis of said core.

6. A polarized electromagnet as set forth in claim 1, wherein said electromagnet is adapted in use to be incorporated in a remotely controllable circuit breaker which comprises first and second movable contacts;

said first contact operatively connected to a switching mechanism so as to be driven thereby to move between an OFF position and an ON position;

said switching mechanism including a manual handle connected to move said first contact arm between said OFF position and said ON position and including trip means, said trip means acting to forcibly move said first contact to its OFF position from its ON position upon the occurrence of an overcurrent flowing through the circuit of the breaker; and said second contact operatively connected to one of said core so that it is driven thereby in response to a remote control signal energizing said excitation coil to move between an operative position where said second contact is permitted to come into in engagement with said first contact in said ON position and an inoperative position where said second contact is away from said first contact to be inhibited from contacting with said first contact irrespective of the positions thereof.

7. A polarized electromagnet as set forth in claim 5, wherein said core is fixed at its one end to said pole plate and to a joint through which said core is operatively connected to said second contact, said joint including a ring for rigid connection with said end of said core, said core formed at said one end with an axially extending center stud which defines on the remaining face of said one end a shouldered stop, said center stud extending through said pole plate and said ring so that said pole plate is held between said shouldered stop and said ring, said ring formed around in its inner periphery opposite to said pole plate with a bevelled brim with which the adjacent portion of said center stud engages by being partially deformed for rigid connection of said joint and said pole plate to said core.

* * * * *